US006827333B1

(12) United States Patent
Lutz

(10) Patent No.: US 6,827,333 B1
(45) Date of Patent: Dec. 7, 2004

(54) HAMMER WITH EXTENDIBLE FULCRUM

(76) Inventor: Otis P. Lutz, 3820 Minton Rd., Melbourne, FL (US) 32904

( * ) Notice: Subject to any disclaimer, the term of this patent is extended or adjusted under 35 U.S.C. 154(b) by 0 days.

(21) Appl. No.: 10/651,732

(22) Filed: Aug. 29, 2003

(51) Int. Cl.[7] ..... B25C 11/00
(52) U.S. Cl. ..... 254/26 E
(58) Field of Search ..... 254/26 E, 26 R, 254/27

(56) References Cited

U.S. PATENT DOCUMENTS 540,967 A * 6/1895 Eveleth ..... 254/26 E
4,422,620 A * 12/1983 Nitzberg ..... 254/26 E

* cited by examiner

*Primary Examiner*—Robert C. Watson

(57) ABSTRACT

A hammer with extendible fulcrum for easing nail removal comprises a handle having a bore. A claw head is connected to the handle. An elongate extension arm is slidably connected to the handle. The extension arm has a locking notch therein. A locking arm is detachably connectable to the extension arm locking notch. A button guard is connected to the handle and extends beyond the handle. A release button is slidably connected to the button guard. The release button is connected to the locking arm for actuating the locking arm.

20 Claims, 3 Drawing Sheets

HAMMER WITH EXTENDIBLE FULCRUM

BACKGROUND OF THE INVENTION

1. Field of the Invention

The present invention relates to a hammer with extendible fulcrum for use in connection with hammers. The hammer with extendible fulcrum has particular utility in connection with hammer having an extendible fulcrum with a fulcrum lever guard.

2. Description of the Prior Art

Hammer with extendible fulcrums are desirable for more easily removing nails with a claw type hammer. Currently, to remove nails with a claw type hammer on the head is used as a fulcrum, at times items will be placed under the head to increase the fulcrum arm length of the hammer. A need was felt for a hammer with an extendible portion that would act as a fulcrum arm for the hammer and that had a lever guard so that the fulcrum could not accidentally be released.

The use of hammers is known in the prior art. For example, U.S. Pat. No. 619,325 to Martin discloses a nail drawing device that has a handle and a spring dog. A spring actuated bar has a sliding relation to the handle. The bar has a rack and ratchet teeth which is adapted to engage the rack at an end of the ratchet teeth. When the rack passes the dog the tension of the spring that actuated the bar is given freedom to force the bar continuously outward without further manipulation of the dog until the nail is entirely withdrawn. However, the Martin '325 patent does not have a lever guard to prevent accidental release of the extension arm.

Similarly, U.S. Pat. No. 2,741,456 to Williams discloses a break over hammer that has a head having a cavity therein, a hollow gripping portion, a handle interconnecting the head and the gripping portion and a break over member slidably mounted in the cavity. A rod is affixed to the inner end of the break over and extends slidably through the handle to the gripping portion. A pair of diametrically opposed latch members are radially slidable in the wall of the gripping portion and each have a radially extending slot therein. A U-shaped trigger member longitudinally moves in the gripping portion. Barbed ends of the trigger portion are positioned in the slots. A stem is affixed to the trigger and slidably extends through the outer end of the gripping portion. A control button is affixed to the outer end of the stem. Rack teeth on the free end portion of the rod selectively engage with one of the latch members. An inverted tooth upon the rod is diametrically opposed to the teeth and is capable of engaging with the other of the latch members. Spring means in the gripping portion normally urge the barbed ends out of engagement with the slots in the latch members. However, the Williams '456 patent does not have a lever guard to prevent accidental release of the extension arm.

Lastly, U.S. Pat. No. 540,967 to Eveleth discloses a hand hammer that having a handle, with a claw head secured thereto and provided with a socket aligned with the handle. A plunger is movably mounted in the socket with one end flattened and movably adjustable to project at different distances beyond the head to form a fulcrum for the claw. A means for locking the plunger in the socket. However, the Eveleth '967 patent does not have a lever guard to prevent accidental release of the extension arm.

While the above-described devices fulfill their respective, particular objectives and requirements, the aforementioned patents do not describe a hammer with extendible fulcrum that allows hammer having an extendible fulcrum with a fulcrum lever guard. The Martin '325, Williams '456 and Eveleth '967 patents make no provision for have a lever guard to prevent accidental release of the extension arm.

Therefore, a need exists for a new and improved hammer with extendible fulcrum that can be used for hammer having an extendible fulcrum with a fulcrum lever guard. In this regard, the present invention substantially fulfills this need. In this respect, the hammer with extendible fulcrum according to the present invention substantially departs from the conventional concepts and designs of the prior art, and in doing so provides an apparatus primarily developed for the purpose of hammer having an extendible fulcrum with a fulcrum lever guard.

SUMMARY OF THE INVENTION

In view of the foregoing disadvantages inherent in the known types of hammers now present in the prior art, the present invention provides an improved hammer with extendible fulcrum, and overcomes the above-mentioned disadvantages and drawbacks of the prior art. As such, the general purpose of the present invention, which will be described subsequently in greater detail, is to provide a new and improved hammer with extendible fulcrum and method which has all the advantages of the prior art mentioned heretofore and many novel features that result in a hammer with extendible fulcrum which is not anticipated, rendered obvious, suggested, or even implied by the prior art, either alone or in any combination thereof.

To attain this, the present invention essentially comprises a handle having a bore. A claw head is connected to the handle. An elongate extension arm is slidably connected to the handle. The extension arm has a locking notch therein. A locking arm is detachably connectable to the extension arm locking notch. A button guard is connected to the handle and extends beyond the handle. A release button is slidably connected to the button guard. The release button is connected to the locking arm for actuating the locking arm.

There has thus been outlined, rather broadly, the more important features of the invention in order that the detailed description thereof that follows may be better understood and in order that the present contribution to the art may be better appreciated.

The invention may also include a button spring, an extension spring, a rubber grip and an extension arm rocker portion. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, there fore, that the claims be regarded as including such equivalent constructions insofar as they do not depart from the spirit and scope of the present invention.

It is therefore an object of the present invention to provide a new and improved hammer with extendible fulcrum that has all of the advantages of the prior art hammers and none of the disadvantages.

It is another object of the present invention to provide a new and improved hammer with extendible fulcrum that may be easily and efficiently manufactured and marketed.

An even further object of the present invention is to provide a new and improved hammer with extendible fulcrum that has a low cost of manufacture with regard to both materials and labor, and which accordingly is then susceptible of low prices of sale to the consuming public, thereby making such hammer with extendible fulcrum economically available to the buying public.

Still another object of the present invention is to provide a new hammer with extendible fulcrum that provides in the apparatuses and methods of the prior art some of the advantages thereof, while simultaneously overcoming some of the disadvantages normally associated therewith.

Lastly, it is an object of the present invention is to provide a hammer with extendible fulcrum for hammer having an extendible fulcrum with a fulcrum lever guard.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description males reference to the annexed drawings wherein.

The same reference numerals refer to the same parts throughout the various figures.

DESCRIPTION OF THE PREFERRED EMBODIMENT

Figure 1:
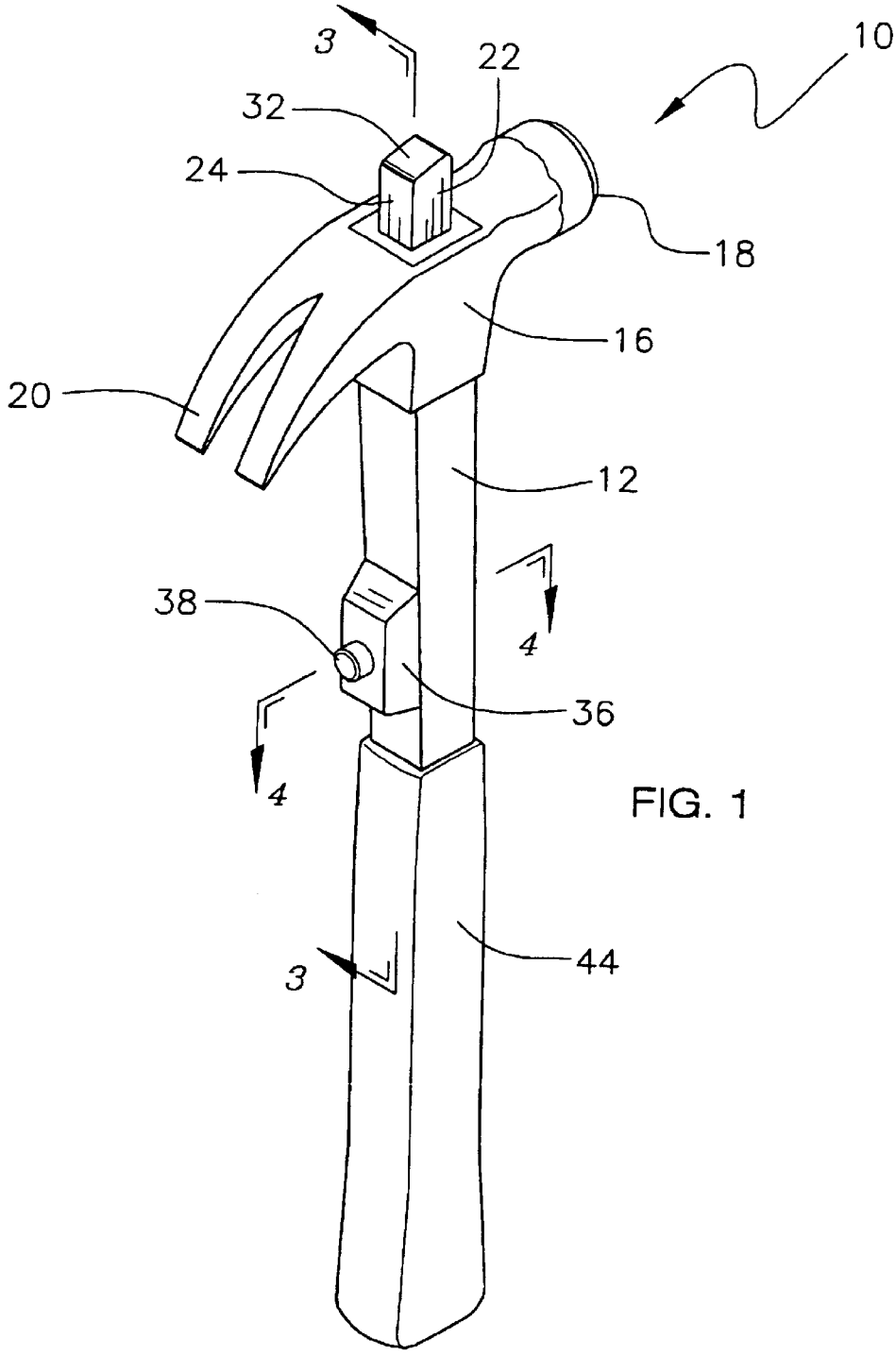
FIG. 1 is a top perspective view of the preferred embodiment of the hammer with extendible fulcrum constructed in accordance with the principles of the present invention.

Referring now to the drawings, and particularly to FIGS. 1–4, a preferred embodiment of the hammer with extendible fulcrum of the present invention is shown and generally designated by the reference numeral 10.

In FIG. 1, a new and improved hammer with extendible fulcrum 10 of the present invention for hammer having an extendible fulcrum with a fulcrum lever guard is illustrated and will be described. More particularly, the hammer with extendible fulcrum 10 has a handle 12 which has a bore 14 therein (shown in FIG. 3). A claw head 16 is connected to the handle 12. The claw head 16 has two opposite ends, a hammer head end 18 and a claw end 20. An elongate extension arm 22 is slidably connected to the handle 12. The extension arm 22 is deposited within the handle bore 14. The extension arm 22 has an integral rocker portion 32 upon an extension arm first end 24 toward the claw head hammer head end 18. A button guard 36 is connected to the handle 12. The button guard 36 extends beyond the handle 12. A release button 38 is slidably connected to the button guard 36. The button guard 36 keeps the user's hand from accidentally pushing the release button 38. A rubber grip 44 is connected to the handle 12.

Figure 2:
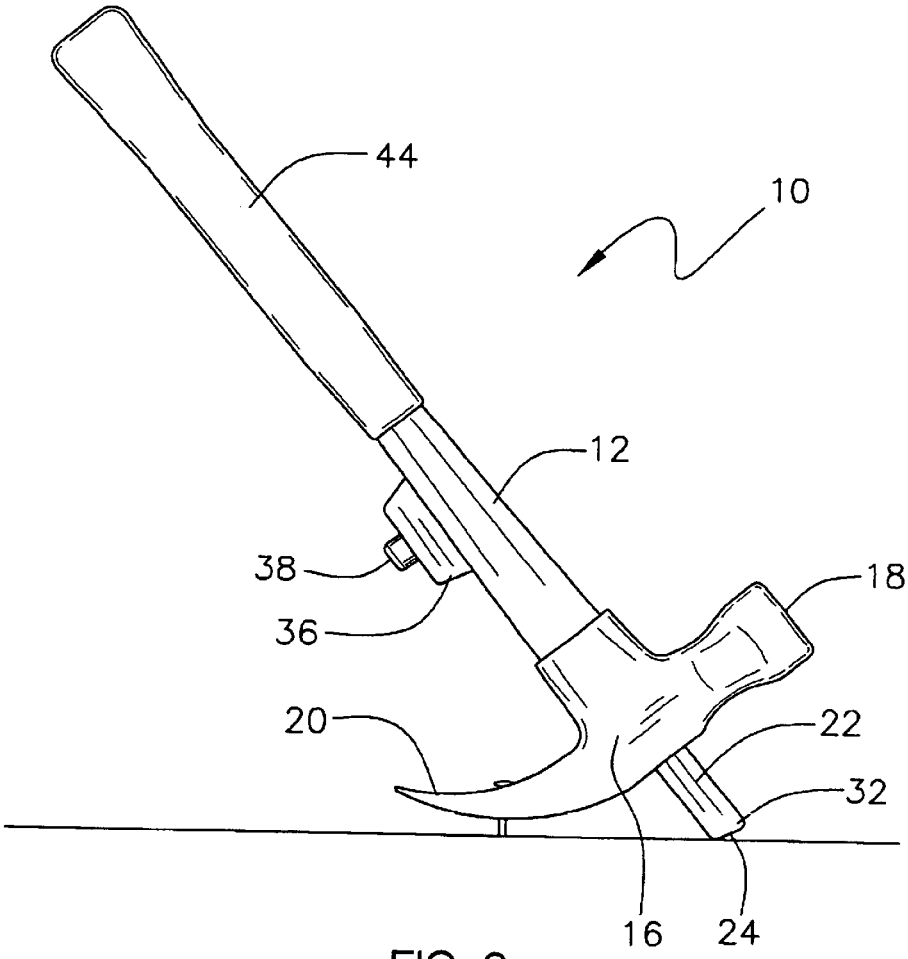
FIG. 2 is a right side view of the hammer with extendible fulcrum of the present invention.

In FIG. 2, the hammer with extendible fulcrum 10 is illustrated and will be described. More particularly, the hammer with extendible fulcrum 10 has the handle 12 which has the bore 14 therein (shown in FIG. 3). The claw head 16 is connected to the handle 12. The claw head 16 has two opposite ends, the hammer head end 18 and the claw end 20. The elongate extension arm 22 is slidably connected to the handle 12. The extension arm 22 is deposited within the handle bore 14. The extension arm 22 has the integral rocker portion 32 upon the extension arm first end 24 toward the claw head hammer head end 18. The button guard 36 is connected to the handle 12. The button guard 36 extends beyond the handle 12. The release button 38 is slidably connected to the button guard 36. The rubber grip 44 is connected to the handle 12.

Figures 3, 4:
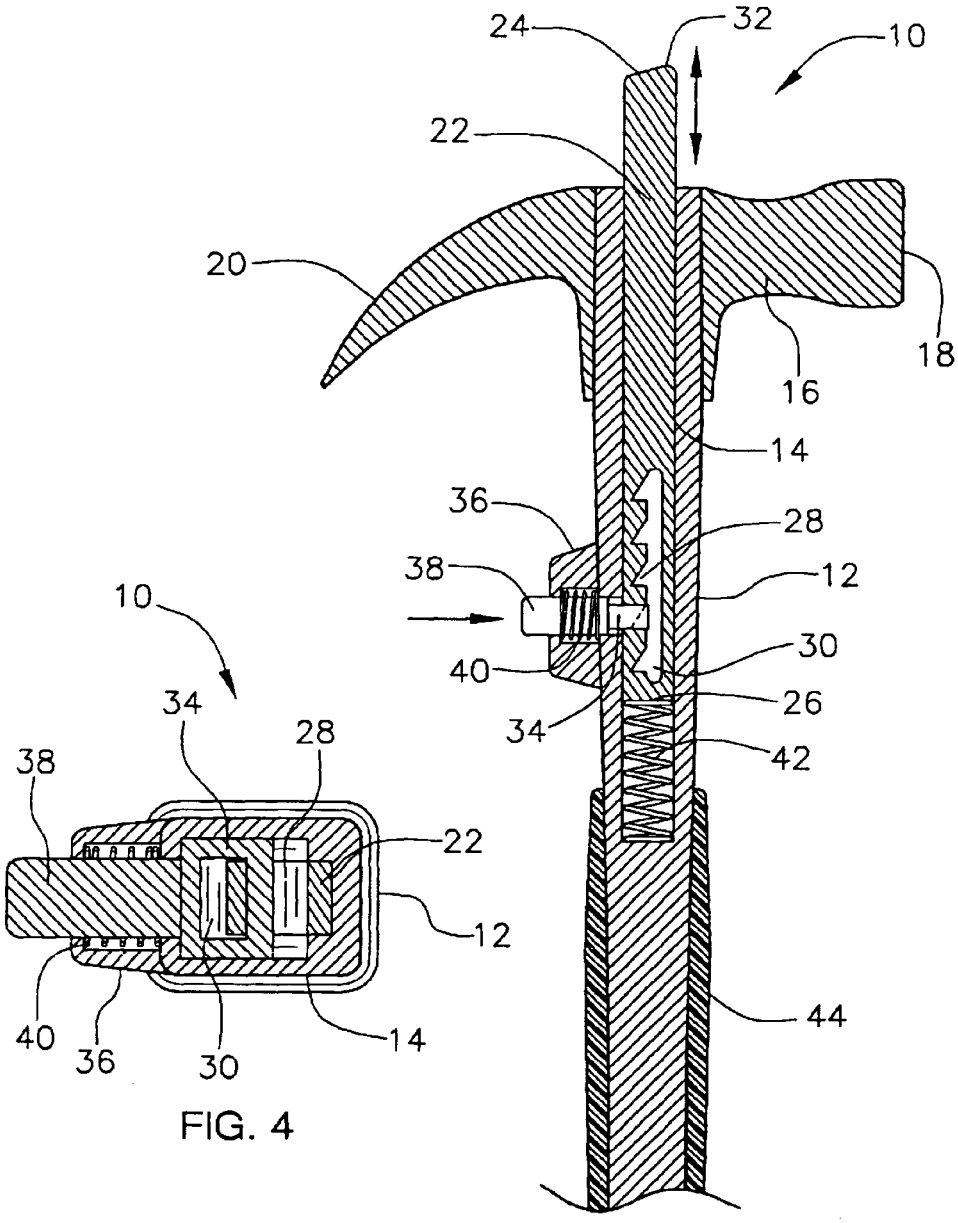
FIG. 3 is a section 3—3 view of FIG. 1 of the hammer with extendible fulcrum of the present invention.
FIG. 4 is a section 4—4 view of FIG. 1 of the hammer with extendible fulcrum of the present invention.

In FIG. 3, the hammer with extendible fulcrum 10 is illustrated and will be described. More particularly, the hammer with extendible fulcrum 10 has the handle 12 which has the bore 14 therein. The: claw head 16 is connected to the handle 12. The claw head 16 has two opposite ends, the hammer head end 18 and the claw end 20. The elongate extension arm 22 is slidably connected to the handle 12. The extension arm 22 has a plurality of locking notches 28. The extension arm 22 has a locking slot 30 therein. The extension arm 22 has two opposite ends, the first end 24 and a second end 26. The extension arm 22 has the outer shape complementary to the handle bore 14. The extension arm 22 is deposited within the handle bore 14. The extension arm 22 has the integral rocker portion 32 upon the extension arm first end 24 toward the claw head hammer head end 18. A locking arm 34 is slidably connected to the handle 12. The locking arm 34 is detachably connectable to the extension arm locking notch 28. The locking arm 34 is disposed within the locking slot 30. The button guard 36 is connected to the handle 12. The button guard 36 extends beyond the handle 12. The release button 38 is slidably connected to the button guard 36. The release button 38 is connected to the locking arm 34 for actuating the locking arm 34. A button spring 40 is connected to the release button 38. An extension spring 42 is connected to the extension arm 22. The extension spring 42 is connected to the extension arm second end, 26. The rubber grip 44 is connected to the handle 12.

In FIG. 4, the hammer with extendible fulcrum 10 is illustrated and will be described. More particularly, the hammer with extendible fulcrum 10 has the handle 12 which has the bore 14 therein. The: extension arm 22 has the plurality of locking notches 28. The extension arm 22 has the locking slot 30 therein. The extension arm 22 has the outer shape complementary to the handle bore 14. The extension arm 22 is deposited within the handle bore 14. The locking arm 34 is slidably connected to the handle 12. The locking arm 34 is detachably connectable to the extension arm locking notch 28. The locking arm 34 is disposed within the locking slot 30. The button guard 36 is connected to the handle 12. The button guard 36 extends beyond the handle 12. The release button 38 is slidably connected to the button guard 36. The release button 38 is connected to the locking arm 34 for actuating the locking arm 34. The button spring 40 is connected to the release button 38.

In use it can now be seen when the release button 38 is depressed the locking arm 34 would disengage and allow the extension arm 22 to slide up and down within the handle bore 14. When the release button 38 is released, the locking arm 22 would catch one of the extension arm locking notches 28 lining the extension arm 22. The extension arm 22 would be locked at this adjusted setting. The button guard 36 keeps the user's hand from accidentally pushing the release button.

While a preferred embodiment of the hammer with extendible fulcrum has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as reinforced fiber or a variety of wood may be used instead of the metal handle described. Also, the extension arm may also be made of heavy-duty plastic, wood, or metal. And although hammer having an extendible fulcrum with a fulcrum lever guard have been described, it should be appreciated that the hammer with extendible fulcrum herein described is also suitable for pry bars.

Therefore, the foregoing is considered as illustrative only of the principles of the invention. Further, since numerous modifications and changes will readily occur to those skilled in the art, it is riot desired to limit the invention to the exact construction and operation shown and described, and accordingly, all suitable modifications and equivalents may be resorted to, falling within the scope of the invention.

I claim:

1. A hammer with extendible fulcrum comprising:

a handle having a bore therein;

a claw head connected to said handle, said claw head having two opposite ends, a hammer head end and a claw end;

an elongate extension arm slidably connected to said handle, said extension arm having a locking notch therein, said extension arm having two opposite ends, a first end and a second end;

a locking arm slidably connected to said handle, said locking arm detachably connectable to said extension arm locking notch;

a button guard connected to said handle, said button guard extending beyond said handle; and a release button slidably connected to said button guard, said release button connected to said locking arm for actuating said locking arm.

2. The hammer with extendible fulcrum of claim 1 further comprising:

a button spring connected to said release button.

3. The hammer with extendible fulcrum of claim 1 further comprising:

an extension spring connected to said extension arm.

4. The hammer with extendible fulcrum of claim 1 wherein:

said extension spring is connected to said extension arm second end.

5. The hammer with extendible fulcrum of claim 1 wherein:

said extension arm has a plurality of locking notches.

6. The hammer with extendible fulcrum of claim 1 further comprising:

a rubber grip connected to said handle.

7. The hammer with extendible fulcrum of claim 1 wherein:

said extension arm has an outer shape complementary to said handle bore, said extension arm deposited within said handle bore.

8. The hammer with extendible fulcrum of claim 1 wherein:

said extension arm having a locking slot therein.

9. The hammer with extendible fulcrum of claim 8 wherein:

said locking arm is disposed within said locking slot.

10. The hammer with extendible fulcrum of claim 1 wherein:

said extension arm having an integral rocker portion upon said extension arm first end toward said claw head hammer head end.

11. A hammer with extendible fulcrum comprising:

a handle having a bore therein;

a claw head connected to said handle, said claw head having two opposite ends, a hammer head end and a claw end;

an elongate extension arm slidably connected to said handle, said extension arm having a locking notch therein, said extension arm having two opposite ends, a first end and a second end;

a locking arm slidably connected to said handle, said locking arm detachably connectable to said extension arm locking notch;

to a button guard connected to said handle, said button guard extending beyond said handle;

a release button slidably connected to said button guard, said release button connected to said locking arm for actuating said locking arm; and a button spring connected to said release button.

12. The hammer with extendible fulcrum of claim 11 further comprising:

an extension spring connected to said extension arm.

13. The hammer with extendible fulcrum of claim 12 wherein said extension spring is connected to said extension arm second end.

14. The hammer with extendible fulcrum of claim 13 wherein:

said extension arm has a plurality of locking notches.

15. The hammer with extendible fulcrum of claim 14 further comprising:

a rubber grip connected to said handle.

16. The hammer with extendible fulcrum of claim 15 wherein:

said extension arm has an outer shape complementary to said handle bore, said extension arm deposited within said handle bore.

17. The hammer with extendible fulcrum of claim 16 wherein:

said extension arm having a locking slot therein.

18. The hammer with extendible fulcrum of claim 17 wherein:

said locking arm is disposed within said locking slot.

19. The hammer with extendible fulcrum of claim 18 wherein said extension arm having an integral rocker portion upon said extension arm first end toward said claw head hammer head end.

20. A hammer with extendible fulcrum comprising:

a handle having a bore therein;

a claw head connected to said handle, said claw head having two opposite ends, a hammer head end and a claw end;

an elongate extension arm slidably connected to said handle, said extension arm has a plurality of locking notches, said extension arm having a locking slot therein said extension arm having two opposite ends, a first end and a second end, said extension arm has an outer shape complementary to said handle bore, said extension arm deposited within said handle bore, said extension arm having an integral rocker portion upon said extension arm first end toward said claw head hammer head end;

a locking arm slidably connected to said handle, said locking arm detachably connectable to said extension arm locking notch, said locking arm is disposed within said locking slot;

a button guard connected to said handle, said button guard extending beyond said handle;

a release button slidably connected to said button guard, said release button connected to said locking arm for actuating said locking arm;

a button spring connected to said release button;

an extension spring connected to said extension arm, said extension spring is connected to said extension arm second end; and a rubber grip connected to said handle.

* * * * *